US008281538B2

(12) United States Patent
Waters

(10) Patent No.: US 8,281,538 B2
(45) Date of Patent: Oct. 9, 2012

(54) WALLBOARD REPAIR SYSTEM AND METHOD

(76) Inventor: Joseph C. Waters, Bryan, TX (US)

( * ) Notice: Subject to any disclaimer, the term of this patent is extended or adjusted under 35 U.S.C. 154(b) by 89 days.

(21) Appl. No.: 12/784,368

(22) Filed: May 20, 2010

(65) Prior Publication Data

US 2011/0283645 A1 Nov. 24, 2011

(51) Int. Cl.
*E02D 37/00* (2006.01)

(52) U.S. Cl. ..... 52/514.5; 52/514

(58) Field of Classification Search ..... 52/514, 52/514.5, 741.1; 156/94; 428/63; 264/36
See application file for complete search history.

(56) References Cited

U.S. PATENT DOCUMENTS 2,997,416 A * 8/1961 Helton ..... 156/98
4,193,243 A * 3/1980 Tiner ..... 52/514
4,297,823 A * 11/1981 Keisler ..... 52/514
4,335,554 A * 6/1982 Nicholson ..... 52/514
4,370,842 A * 2/1983 Martin et al. ..... 52/514
4,831,808 A * 5/1989 Wynar ..... 52/715
4,989,385 A * 2/1991 McCullough ..... 52/514
5,269,861 A * 12/1993 Gilbreath ..... 156/98
5,687,523 A * 11/1997 Stough ..... 52/417
6,162,525 A * 12/2000 Amy ..... 428/119
7,380,382 B2 * 6/2008 Hansen ..... 52/514
7,971,405 B2 * 7/2011 Hansen ..... 52/514

* cited by examiner

*Primary Examiner* — William Gilbert
*Assistant Examiner* — Gisele Ford
(74) *Attorney, Agent, or Firm* — Douglas Baldwin

(57) ABSTRACT

The present invention provides a wallboard patching and repair system and method that are quick and easy to install and provides a stronger wall repair than available systems. The system allows a wall to be repaired with or without the use of mechanical fasteners. The invention comprises a system comprising, patch support members that are placed behind the edges of a damaged opening in wallboard and where a portion of each member is placed behind the wallboard at the edge of the opening and the remaining portion extends into the opening to support a wallboard patch. In one embodiment the invention is a kit comprising system components.

17 Claims, 4 Drawing Sheets

WALLBOARD REPAIR SYSTEM AND METHOD

FIELD OF THE INVENTION

This invention relates to repair of damaged wallboard. More specifically it relates to a system, a method and a kit for patching and repairing damaged wallboard, particularly drywall wallboard, by placing a support member, preferably polymer foam, behind an opening to be repaired to provide a sturdy and secure backing onto which a patch is secured.

BACKGROUND

Wallboard, particularly drywall (sheetrock) is the most common material for the interior of residential and commercial buildings. It is widely available, relatively inexpensive, easily installed and somewhat fire retardant. It is, however, relatively easily damaged. Drywall is commonly installed by attaching it to wall "studs", nominally 2 inch×4 inch or 2 inch×6 inch wooden vertical boards (or shaped metal members). The wall "studs" are typically spaced on sixteen (16) or twenty four (24) inch centers. Steel framing is increasing being used in office and apartment construction and has several advantages over wood. Steel studs are perfectly straight, don't shrink or split and are light weight and easy to store, plus they resist fire, insects and rot. They are also easier to move/correct for amateurs. The overall cost between steel framing and wood framing is about the same. For the present invention it does not matter if the wall studs are steel or wood.

Wallboard (dry wall) is prone to damage between wall studs. Damage generally comes from the wallboard being struck by an object, from water leaks or from remodeling requirements.

Many effective methods for repairing drywall damage have been proposed and there have been numerous patents disclosing and claiming various means for wallboard repair. For example, in U.S. Pat. No. 6,378,263, Apr. 30, 2002 there is disclosed a device that that is screwed into the wallboard at the side of the opening to be patched. This patent discloses a number of additional patents for wallboard repair. U.S. Pat. No. 5,299,404, Apr. 5, 1994 discloses a patching kit having a backing plate that is secured to the backside of the wallboard with an adhesive. This patent also discloses a number of additional wallboard repair patents. U.S. Pat. No. 5,018,331, May 28, 1991 discloses a hinged circular backing plate to receive a patch of wallboard. Other patents that disclose wallboard repair means and methods include, U.S. Pat. No. 2,997,416, U.S. Pat. No. 3,717,970, U.S. Pat. No. 4,460,429, U.S. Pat. No. 4,782,642, U.S. Pat. No. 5,268,861 and U.S. Pat. No. 6,378,263. So there has been no shortage of proposals. However, in most of these proposals, the repair means must be specially made, are awkward to use and/or leave the repaired spot weaker that the surrounding wall.

The present invention provides a simple to use, inexpensive system that leaves the repaired portion of the wall stronger than before damage and generally stronger that the remainder of the wall.

SUMMARY

The present invention provides a wallboard patching system and method that is quick and easy to install and provides a stronger wall repair than currently available systems. It offers advantages for individual home owners and general construction contractors making small repairs. The system allows a wall to be repaired with or without the use of mechanical fasteners.

In one aspect the invention comprises patch support members that are to be placed behind the edges of an opening in wallboard wherein a portion of each member is placed behind the wallboard at the edge of the opening and the remaining portion extends into the opening to support a wallboard patch attached thereto. The patch members may have fiberglass mesh and/or a backing material bonded to them on at least one surface to facilitate attachment of a patch and to increase the strength and durability of the repair.

In another embodiment the invention is a method of repairing damaged wallboard in which a patch comprising a rectangular piece of wallboard is cut slightly larger than an area of damage, a matching rectangular opening is cut in the wallboard to remove the damaged wallboard, a suitable adhesive is applied to a patch support member and it is placed behind at least two edges of the rectangular opening extending into the opening and behind the wallboard opening edge and adhering the patch to the patch support members.

In yet another aspect the invention is a kit comprising a length of patch support member, a suitable amount of mesh wallboard tape to complete a reasonable size patch area and sufficient positioning means to position at least one patch job.

DETAILED DESCRIPTION

The present invention is a system and method for patching damaged wallboard. The system comprises patch support members that are placed behind a cutout of damaged wallboard to provide support and attachment means for a wallboard patch.

Figure 1:
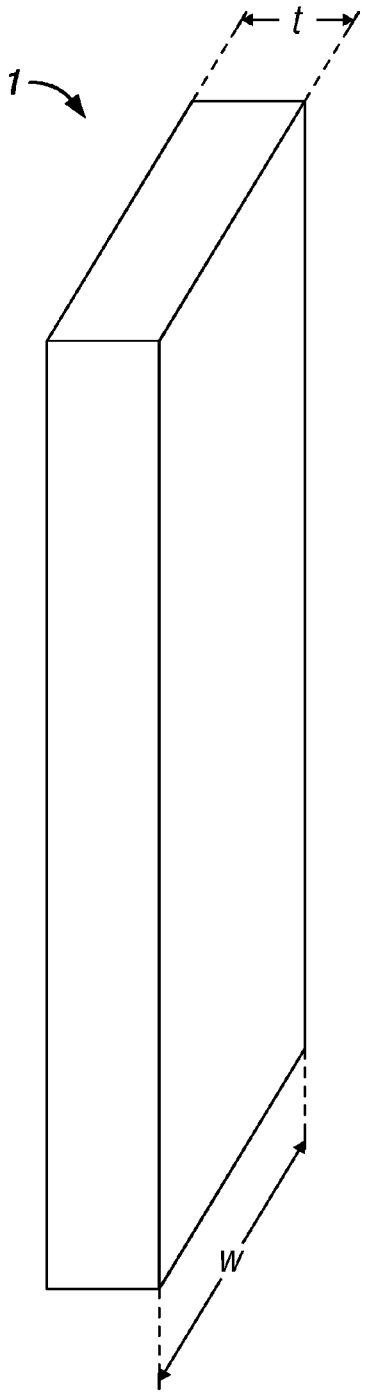
FIG. 1 is an isometric view of a patch support member of the present invention.
Figure 2:
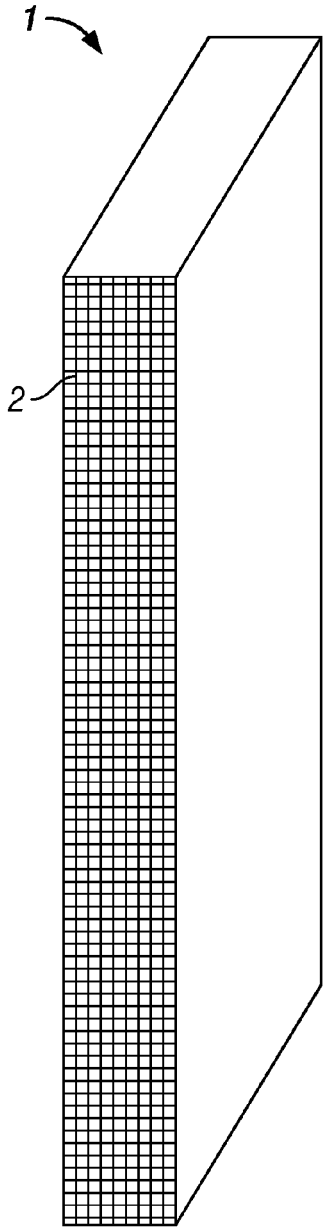
FIG. 2 is an isometric view of a patch support member of the present invention showing a strip of mesh tape bonded to one face of the member.

The invention can be better understood by reference to the Figures. FIGS. 1 and 2 illustrate wallboard patch support members of the invention. FIG. 1 shows a typical member. FIG. 2 shows a member that has bonded to it a wallboard mesh tape to allow better adhesion to the walls and patch piece. As shown in FIG. 1 the patch support member will have a thickness (or "face"), t, of between about ¾ inch and four (4) inches. While the thickness is not especially critical, it is preferred that it be slightly wider than the thickness of a common construction wall support stud, e.g. about 1.7 inches compared to about 1.5 inches for a common stud.

The width, w, will generally and preferably correspond to the depth of the space between walls, for most housing construction that will be the nominal width of a common wall support stud—3.5 inches. However some walls may be of greater depth, as when nominal six (6) inch wall support studs are used, and the width of the support member will be 5.5 inches. Some metal studs and studs used in mobile homes and travel trailers are smaller, usually about two (2) inches. For support members to be used in damaged wallboard that has no corresponding back wall, as in a ceiling the width, w, may be any suitable and convenient width. Therefore, the width, w, of the support member of this invention will suitably be from about one (1) inch to about six (6) inches. These dimensions are appropriate for repairs in the most common wall widths in the United States. Dimensions may be adjusted for use in countries using metric measurements or any other standard of measure.

FIG. 2 illustrates a patch support member having a mesh wallboard tape bonded to one edge. Such mesh tape is preferably adhesively attached to the member and is useful in securing the member to the inside of the walls and to the patch. The mesh tape may be attached as shown or may be on any or all the faces of the member as required. Usually the tape will be bonded to the narrow edge or face. For special purposes the mesh tape may be bonded to the wide edge or to multiple edges.

Drywall tape that is used to seal joints and corners comes in many varieties. The most common is paper tape. For the present invention adhesive backed fiberglass mesh tape is preferred. Fiberglass mesh tape, such as Sheetrock®, Dap 9140 brand tapes, are readily available at hardware and building supply stores. Fiberglass self-adhesive mesh joint tape is made with fiberglass yarns woven into fabrics and usually has a built-in adhesive on one side of the tape. It is very self-adhesive, alkaline-resistant and anti-corrosive. It is not be easily torn, does not shrink or stretch. It is stronger than paper tape, resists tears and is more resistant to forming cracks at the finished edges. Self-adhesive tape reduces taping time. In this invention it is adhered to the patch support member and also recommended for taping the seams of the patched wall. After the patch is in place, the joints are taped (paper or mesh) and floated with joint compound. Floating as the term is used herein means the process of spreading joint compound over the seam of the repair (where patch edge and wallboard edge meet) and, in successive steps, tapering outward from the seam to reduce any appearance of a bulge at the point of the seam.

In some applications mechanical fasteners may be desired or required. For example, when polymer or expanded polystyrene is used, a backer strip of dense plastic, light gauge metal or a wood strip of suitable thickness may be bonded between the drywall mesh tape and the patch support member or, when it becomes available, a commercially produced member comprised of significantly differing internal density, may be used to provide an anchor for suitable screws. An alternative is to place an approximately two (2) inch wide appropriately shaped piece of light metal over the face of the patch support member at the locations where a screw is desired. After the patch support member is in place pilot holes may be drilled through the wallboard and wallboard patch into the sheet metal and screws driven into the metal through the holes. A third alternative for light stress applications is to use wide plastic screws such as found in screw type wallboard anchoring systems. Generally, these plastic specialty screws are simpler and are sufficient.

In one embodiment the center of the patch support member will be marked with a line, either printed on the surface or by an indentation in the material, or both, along the long axis. A similar marking will be placed perpendicular to the long axis at a distance equal to one-half of the width of the short axis. For a two (2) inch wide member that would be at one inch from each end of the member. The patch support members are provided in standard lengths and are preferably designed to be cut to the appropriate size for the damaged opening to be repaired. If the member is cut one end will retain the cross mark in most cases. If scrap members are being used and the end mark is not present the installer may measure back one half the width of the member (generally one inch) to determine where a cross mark would be.

The patch support members may be of any length (top to bottom in FIGS. 1 and 2) but, for convenience, a length of about 12 to 48 inches is preferred. A 36 inch length packaged in pairs is well suited for use in a kit as is discussed below. In one embodiment the length will be sufficient to provide, when cut, sufficient material to patch a 12 inch×24 inch wallboard opening.

Patch support members are constructed of any lightweight, easily cut material, including wood such as "balsa wood" and suitable polymer materials, especially foams. It is preferred, in one embodiment, that members be made of reasonably dense expanded polystyrene. Expanded polystyrene comes in different densities and for this invention a density of approximately that used as electronic packing material is especially suitable. Expanded polystyrene (EPS) is usually white and made of pre-expanded polystyrene beads. Such polystyrene is commonly used in molded sheets for building insulation and packing material for cushioning fragile items inside boxes. Extruded polystyrene foam (XPS) consists of closed cells, offers improved surface roughness as higher stiffness and reduced thermal conductivity. The density range is about 28-45 kg/m$^3$. Because of the extrusion manufacturing process, XPS does not require facers to maintain its thermal or physical property performance. Trade names for XPS include "Styrofoam", "Foamular", "Greenguard" and "Foamcore".

Figure 3:
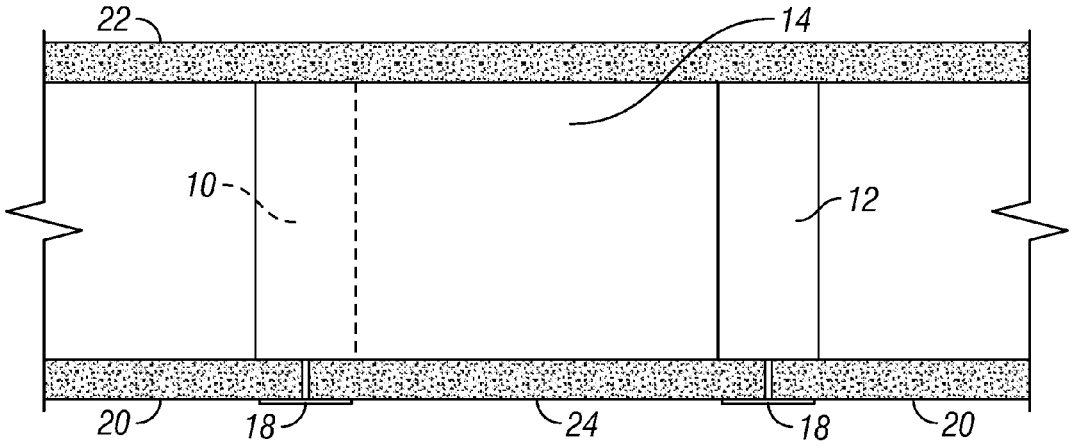
FIG. 3 is a top view of a wall constructed with wallboard showing the placement of patch support members and a patch.
Figure 4:
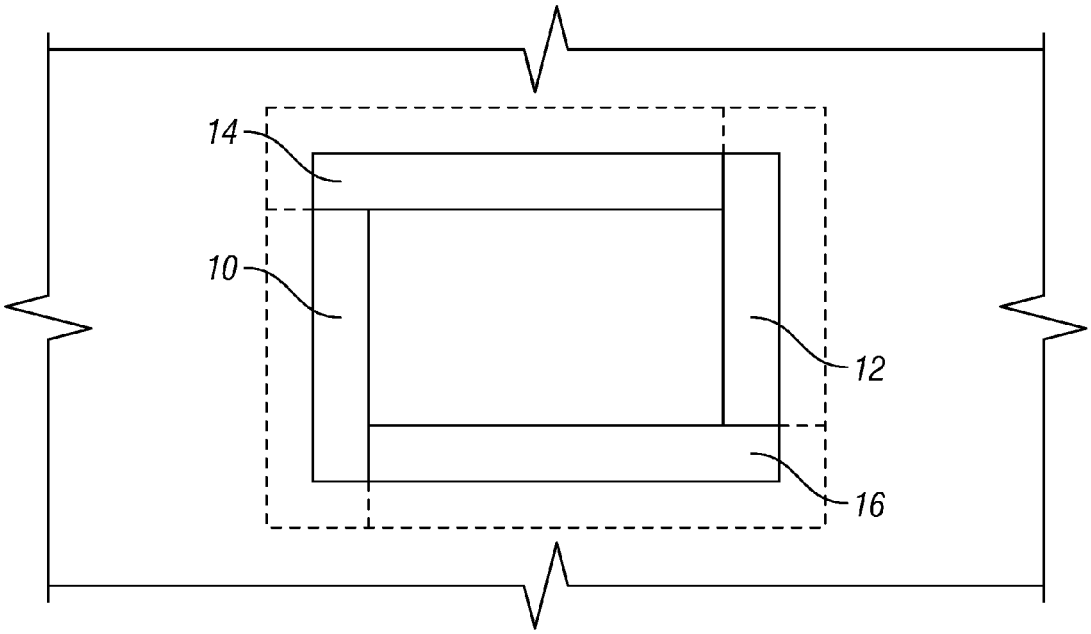
FIG. 4 is a front view of the wallboard of FIG. 3.

FIG. 3 shows a top view of an embodiment of the invention. Wallboards 22 and 20 are separated to form a cavity (space) into which the patch support members fits. Member 14 is a top member and member 16 is a bottom member. Member 10 is a left side vertical and member 12 is right side vertical. There is a matching bottom member 16 for member 14 and a matching vertical member 10 for vertical member 12 as can be seen in FIG. 4. In FIG. 3 item 24 is the patch that fits into a rectangular cutout of wallboard 20. As also shown in FIG. 4 it is preferred that the members be staggered as shown with 14 resting on top of member 10 and vertical member 12 resting on top of member 16. As shown the member are preferably arranged about one half width behind the wallboard and one half extending into the opening to support the patch. The members may be positioned and held in place by positioning means (such as pins or round toothpicks). The positioning means can be made of wood, plastic or other suitable material. They may be designed to be placed in a patch support member straight or at a slight inclination of about thirty degrees or less from perpendicular to the wall being repaired. Two positioning means are used for each patch support member piece. The positioning means serve as positioning devices and also aid in manipulating the patch support member into place. One such means is required at the intersection of the two scribed lines (if such lines are provided on the member) for the lower horizontal member, and for the vertical member placed in the lower position of the two vertical members. The other positioning means may be placed at the most convenient location on the center line of the member. An additional positioning means will be placed on the inside edge of the higher positioned vertical member. It will be placed one patch support member width below the upper most end of that vertical to provide support for the free end of the upper horizontal member.

Figure 5:
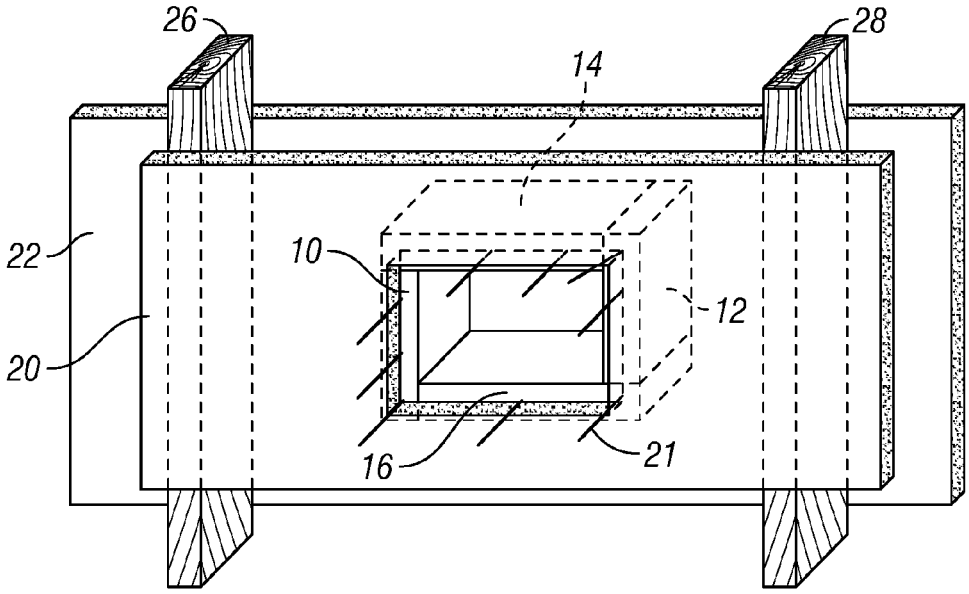
FIG. 5 is an isometric view of a wall section showing the placement of patch support members in an opening in the wall.
Figure 6:
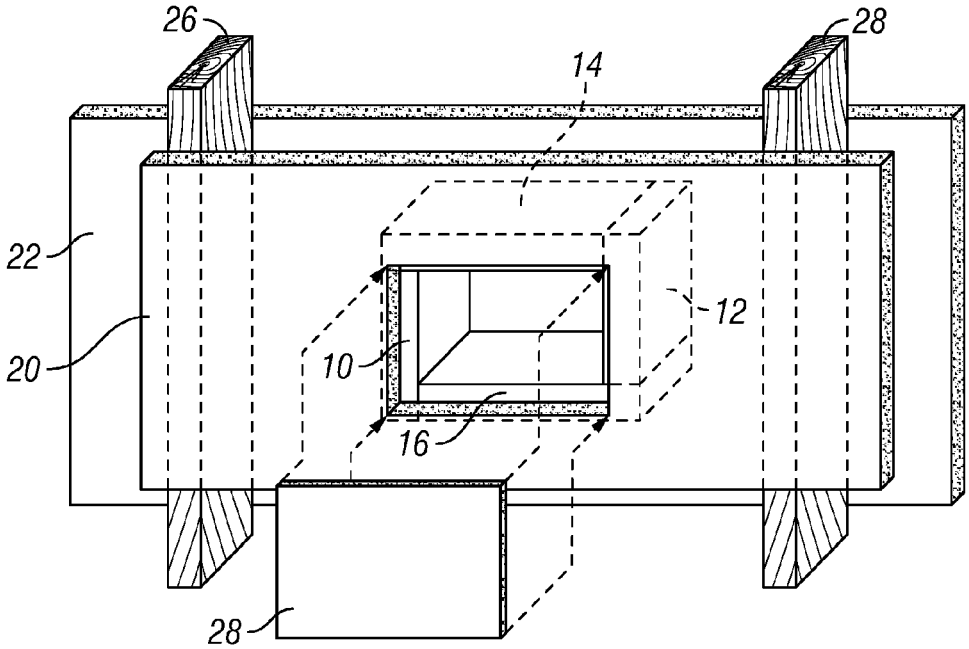
FIG. 6 is an isometric view of a wall section showing the placement of patch support members in an opening in the wall and the placement of a patch.

Placements of positioning means are shown in FIG. 5 item 21. FIGS. 5 and 6 are isometric views of embodiments of the invention. FIGS. 5 and 6 illustrate wallboard 20 attached to wall support stud 28 with a back wall 22. FIG. 5 illustrates placement of the positioning means 21, and placement of the patch support members 14, 12, 16 and 10. FIG. 6 shows how patch 28 is fitted into a rectangular cutout of wall board 20.

Figure 7:
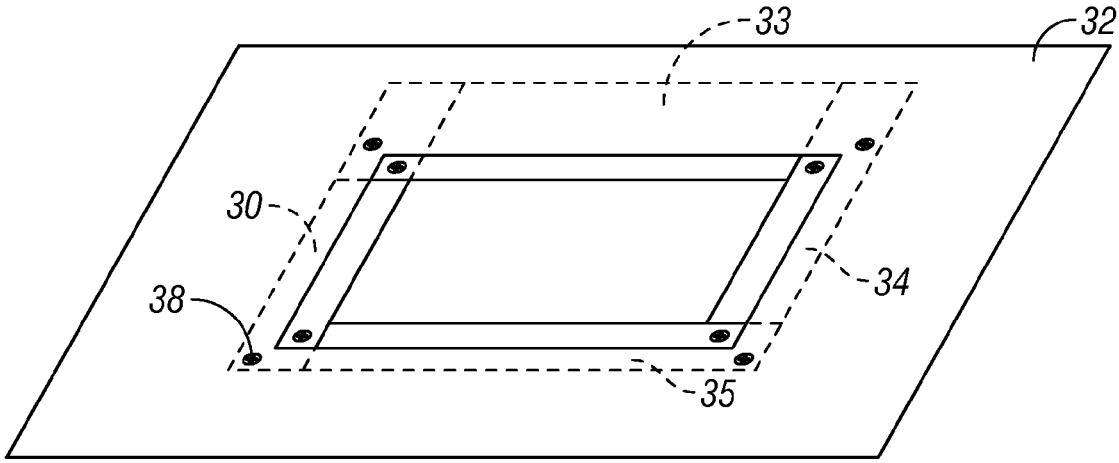
FIG. 7 is an isometric view of a ceiling section showing the placement of patch support members in an opening and placement of attaching or holding means to secure a patch until repair is completed.
Figure 8:
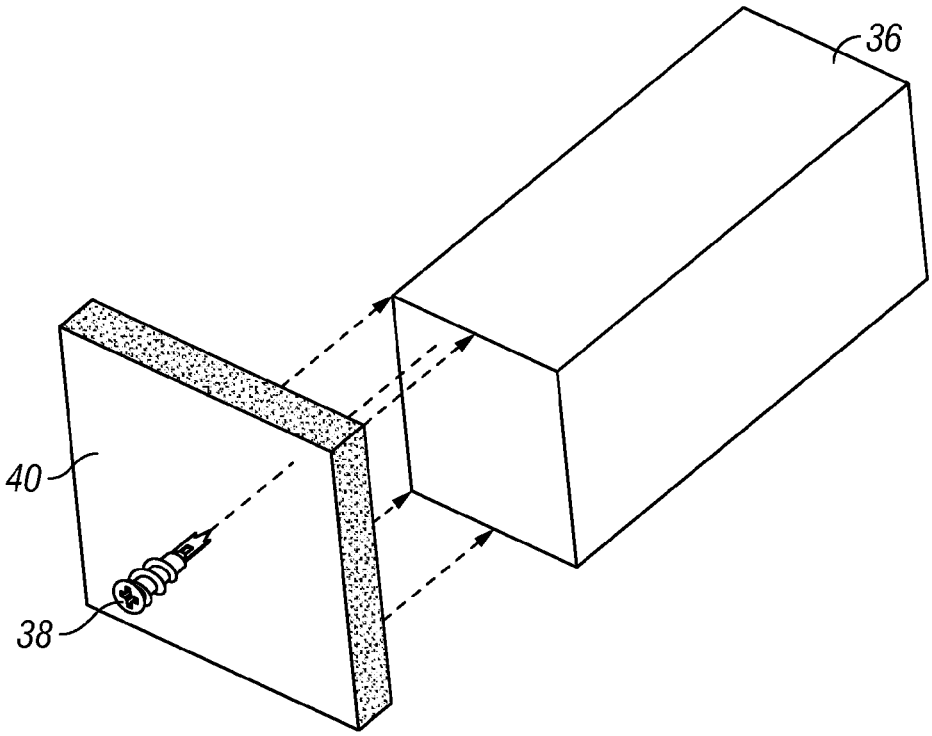
FIG. 8 is an isometric view of a patch secured by a holding means to a patch support member.

FIGS. 7 and 8 illustrate use of the patch support members for patches in wallboard where there is no back-wall—as in ceilings. FIG. 7 shows a cutout in a ceiling wallboard with patch support members 33, 34, 35 and 30 in place. Since there is no back-wall to hold the patch support members in place another means is necessary to hold them against the patched wallboard 32 until the patch adhesive (or joint compound) is set. This is done by use of attachment or holding means 38 located around the opening on at least two sides of the circumference of the patch rectangle. There is shown an attachment means 38 on each corner of the patch 40 and on the wallboard at each corner of the patch rectangle. As shown in FIG. 8 the attachment means 38 attaches the patch, 40, to member 36 and also to the wallboard. The attachment means may be a screw, a hook or other convenient means for holding the parts together—a strong bond or hold in not necessary but only one secure enough to hold until the patch adhesive sets. Screw anchors as shown in FIG. 8 are particularly useful means of holding the pieces together. These anchors are inexpensive, lightweight and provide a secure bond and have a wide track that makes for a secure and speedy attachment. If a pre-packaged anchoring kit is cannibalized, only the plastic anchor screw part is used. Deep threaded plastic screws are preferred over regular plastic (or metal) screws (which are also usable) because of the wide thread provides a more secure hold with less pressure.

The following description illustrates the way in which the system and method of this invention may be used: First, cut sections of patch support members to appropriate lengths. If the support member does not have a bonded mesh strip on the wide side apply a wide strip of self-adhesive fiberglass drywall tape to the wide side of the member. It is appropriate to pre-drill small pilot holes in the wallboard, both the wall and the patch and to install positioning means such as pins or toothpicks. Apply drywall compound or adhesive to the taped surface and install the members appropriately aligned at the repair opening. Hold the member in place and install anchor screws by hand. They should not be over tightened. If the screws do not initially seat flush with the surface of the wallboard, back out the screw slightly and re-tighten. Re-tightening once or twice should seat the screw appropriately. After the patch support members are in place, gently press the patch into place. Any additional compound or adhesive, if applied to the patch, should be very thin. Insert the screws and hand-tighten. As before, if a screw is not seated flush, gently back the screw out and re-tighten. Install self adhesive mesh drywall tape to the seams and joints. The purpose of the screws is to maintain position and some pressure until the dry wall compound or adhesive sets therefore if they cannot be made flush with the wallboard they may be removed later. If the screws need to be removed use a utility knife to carefully cut a hole in the tape over each screw. Remove the screws only after the compound has set. They will be easy to see through the initial float. Be careful to clean the screw slot so that no excess force is required. Fill the screw hole with a tightly rolled piece of drywall tape and finish floating. For those who are unaccustomed to using screws in this manner it may be best practice to practice on a piece of scrap wallboard.

If the patch supporting member has been manufactured with a screw holding backer, or if it comprises a shaped light metal channel, or other device placed over the face of the patch support member, after the member has been placed behind the existing wallboard appropriate sheet metal drywall screws may be used to secure the wallboard to the stud. The mechanical bond will be between the securing device and the screw. Because of the torque exerted by the screws care must be taken to insure the patch support member remains properly located. To insert the screws pilot holes may be drilled through the wallboard and retainer into the patch support member to properly align the screws driven through the wallboard into the member. Alternatively patch support members with pre-drilled holes may be used. If pre-drilled holes are used, an appropriate template should be used to position of the screws accurately to align the screws with the pre-drilled holes.

As used herein the term joint or drywall compound means that premixed or mixable material sold specifically for taping and floating drywall. Joint compound is a white substance similar to plaster used to seal joints between sheets of drywall, primarily in building construction. The compound typically is a complex combination comprising water, limestone, expanded perlite, ethylene-vinyl acetate polymer and attapulgite. This mixture of compounds gives it a very creamy texture which allows it to spread onto surface with ease. There are several types of joint compound used for separate applications in the drywall process—taping, topping and all-purpose compounds. Generally, taping or all-purpose compound in suitable for use in this invention but topping compound may be used as a finish.

Methods of the Invention

In a typical application and one embodiment of the present invention a wallboard that has damage, such as a hole or crack penetrating a section of drywall between two wall support studs, a rectangular piece of wallboard is cut slightly larger than the area of damage. The patch is placed over the damaged area. The edges of the patch are traced onto the wall to be repaired. The marked area is cut out and removed from the wall. Pieces of a patch support member are cut to an appropriate length. Generally the patch support member will be cut to fit the opening so that the most support is given to the installed patch. An easy method is to cut two patch support members the length of the patch, and two members the width of the patch. This method provides a complete perimeter and adds to the strength of the repair. Once the members are cut to length positioning means (such as pins or toothpicks) are placed insure proper spacing and ease of manipulation. Then the taped portion of the member (if any) may be covered with drywall compound (as an adhesive) or any other suitable adhesive. The adhesive bonds the members to the interior of the wall under repair and to the patch. The sections are manipulated through the opening so that the back of the member rests on the opposite wall of the wall cavity, and the taped and coated front of the member rests against the back of the wall under repair. The members will form a perimeter about the opening so that half the width of the patch support member is behind the wall and half the width is exposed in the opening. A thin coat of drywall compound (or adhesive) may be applied to the back side of the patch along the perimeter.

The patch is manipulated into position in the repair opening and firmly pushed in so its surface is flush with the outside surface of the wall under repair. The positions means (such as toothpicks or pins) are removed (or broken off, or pushed into the member flush with the wall depending on the installer's preference). The patch edges are taped and floated with an initial coat of drywall compound. After setting or drying according to the compound manufacturer's recommendation, the repair is ready for final floating and finishing to match the surrounding wall texture.

Where there is no supporting back wall, as in ceilings, the method comprises the following steps: cutting sections to appropriate lengths; applying a wide strip of self-adhesive fiberglass drywall tape to the wide side of the member; pre-drilling pilot holes in the wallboard, both the wall and the patch; appropriately installing positioning pins or toothpicks; applying drywall compound or adhesive to the taped surface; appropriately aligning the patch support member at the repair opening; installing anchor screws (as described above) by hand; positioning the patch after the members are in position; pressing the patch gently into place; applying no more than a thin layer of additional compound or adhesive; inserting and hand-tightening the screw; and taping and coating the seams with joint compound. If a screw is not seated flush it should be backed slightly and re-tightened. The screws should not be over tightened. It is best to practice on scrap first. The purpose of the screws is to maintain position and some pressure until the wallboard compound or adhesive sets. If the screws do not mount flush with the wallboard they may be removed later. If the screws need to be removed use a utility knife to carefully cut a hole in the tape over each screw. The screws are removed only after the compound has set. The only reason to remove the screws is if it were not possible to make them sufficiently flush with the wallboard surface. They will be easy to see through the initial float. Care should be taken to clean the screw slot so that no excess force is required to remove them. The screw hole can be filled with tightly rolled piece drywall tape and joint compound before finish floating.

If the patch supporting member has been manufactured with a screw holding backer, or if it comprises a shaped light metal channel, or other device, has been placed over the face of the patch support member, after the member has been placed behind the existing wallboard appropriate sheet metal drywall screws may be used to secure the wallboard to the member as described above.

If there is insulation between the walls some additional steps are preferred to preserve the integrity of the insulation. If the insulation is in bats, the insulation may be simply cut away. Polymer foam such as expanded polystyrene patch support members are good insulators. The cavity formed by the repair studs may be filled with the bat insulation before the patch is put into place. If the wall cavity contains loose insulation, as can be determined by looking behind the damaged area, there are two possibilities. One, if the insulation is sufficiently stable a length of patch support member may be pushed up inside the wall after the cut is made to keep insulation from falling out. Or two, if the insulation is very loose, a series of small holes may be drilled about two (2) to four (4) inches above, and along the sides of the area to be cut out. Appropriate expandable foam can be sprayed into the holes. The compression from the expanded foam will prevent the insulation from falling.

A Kit

In another embodiment the present invention is a kit comprising a length of patch support material, mesh tape for completing the patching of a damaged wallboard (as detailed above) and positioning means. Optionally, the kit will also contain wallboard compound, and attaching or holding means to hold a patch into position while a repair is being completed. If the kit includes patch holding means, there are preferably at least four and more preferably eight such means to secure all four corners of a patch.

It is preferred the patch support member be made of a polymer foam material and more particularly an expanded polystyrene material. A length of polymer member of about 24 inches to 48 inches is preferred with 36 inch being particularly preferred. The preferred positioning means are wooden toothpicks and the mesh is fiberglass wallboard tape. In one embodiment the kit comprise a suitable amount of mesh wallboard tape to complete a 12 inch by 24 inch patch opening and sufficient positioning means to position at least one patch job.

The kit is suitably packaged for convenience to allow a single package to supply a low cost efficient method of repairing most wallboard damage.

In the foregoing specification, the invention has been described with reference to specific embodiments thereof. It will, however, be evident that various modifications and changes can be made thereto without departing from the broader spirit and scope of the invention as set forth in the appended claims. The specification is, accordingly, to be regarded in an illustrative rather than a restrictive sense. Therefore, the scope of the invention should be limited only by the appended claims.

The invention claimed is:

1. A wallboard repair system comprising at least one patch support member that is to be placed at a side opposite an exposed surface of a first wallboard attached to framework and at the perimeter of an opening in the first wallboard, wherein a portion of each patch support member is placed at said opposite side of the wallboard at the perimeter of the opening and wherein a surface of each of said patch support member is in contact with said opposite side of the wallboard, each said patch support member surface having a portion that extends beyond the wallboard perimeter to define a free edge and supporting a wallboard patch and wherein at least one said patch support member is held in place by extending from said opposite side of the wallboard being repaired to a second wallboard member having a surface facing said opposite side and located opposite the framework.

2. The system of claim 1 wherein mesh wallboard tape is bonded to at least one wallboard surface at the edge of the opening.

3. The system of claim 1 wherein there is permanently attached to at least one surface of the at least one patch support member a backing strip.

4. The system of claim 3 wherein the backing strip is selected from plastic, light weight metal or wood.

5. The system of claim 1 wherein the at least one patch support members are made from a light-weight, relatively soft material selected from a group consisting of polymers, polymer foams, expanded polystyrenes and light-weight woods.

6. The system of claim 1 wherein there is provided positioning means to position the at least one patch support members into suitable position, the positioning means being placed into the patch support at the perimeter of opening.

7. The system of claim 6 wherein the positioning means are toothpicks.

8. The system of claim 1 wherein the patch is secured into place for repair by a holding means that attaches to the first wallboard, the at least one patch support member and the patch.

9. The system of claim 8 wherein the holding means is a plastic anchor screw.

10. A method of repairing damaged wallboard wherein a patch comprising a rectangular piece of wallboard is cut slightly larger than an area of damage, a matching rectangular opening is cut in the wallboard to remove the damaged wallboard, a patch support member is placed at a side opposite an exposed surface of a first wallboard attached to framework and at the perimeter of an opening in the first wallboard, wherein a portion of each patch support member is placed at said opposite side of the wallboard at the perimeter of the opening wherein a surface of each of said patch support member is in contact with said opposite side of the wallboard, each said patch support member surface having a portion that extends beyond the wallboard perimeter to define a free edge and supporting a wallboard patch and wherein at least one said patch support member is held in place by extending from said opposite side of the wallboard being repaired to a second wallboard member having a surface facing said opposite side and located opposite the framework.

11. The method of claim 10 wherein the at least one patch support member is composed of a relatively soft material and is positioned into place by positioning means, the positioning means being placed into the at least one patch support member at the perimeter of the opening.

12. The method of claim 11 wherein the positioning means are pins composed of metal or wood.

13. The method of claim 10 wherein the patch is secured to the first wallboard by a holding means that attaches to the first wallboard, a support member and the patch.

14. The method of claim 10 wherein there is a mesh tape attached to the at least one patch support member and the tape portion of the at least one patch support member is covered with drywall compound as an adhesive to permanently attach it to the first wallboard and the patch.

15. The method of claim 10 wherein the at least one patch support member is held in proper position by positioning means until the patch is in place and secured to the at least one patch support member.

16. A wallboard repair system comprising at least one patch support member that is to be placed at a side opposite an exposed surface of a first wallboard attached to framework and at the perimeter of an opening in the first wallboard, wherein a portion of each patch support member is placed at said opposite side of the wallboard at the perimeter of the opening and wherein a surface of each of said patch support member is in contact with said opposite side of the wallboard, each said patch support member surface having a portion that extends beyond the wallboard perimeter to define a free edge and supporting a wallboard patch and wherein at least one said patch support member is held in place by a holding means that attaches the wallboard, a support member and the patch and which is connected to said wallboard, support member and patch and wherein there is provided positioning means to position the patch support members into suitable position, the positioning means being placed into the patch support at an edge of an opening.

17. The system of claim 16 wherein the holding means is a plastic anchor screw.

* * * * *